United States Patent [19]

Blatt

[11] Patent Number: 4,982,652

[45] Date of Patent: Jan. 8, 1991

[54] FLUID OPERATED ACTUATOR WITH RECESSED POSITION SENSOR AND RECESSED END CAP FASTENER

[76] Inventor: John A. Blatt, 22 Stratton Pl., Grosse Pointe Shores, Mich. 48236

[21] Appl. No.: 353,965

[22] Filed: May 19, 1989

[51] Int. Cl.[5] ..... F01B 25/26; F01B 31/12

[52] U.S. Cl. ..... 92/5 R; 92/85 B; 92/169.1; 92/170.1; 92/177; 92/165 PR; 92/128; 200/82 E

[58] Field of Search ..... 92/5 R, 85 B, 169.1, 92/170.1, 177, 165 PR, 128; 91/1, DIG. 4; 324/208, 207; 200/82 E, 82 R, 82 A, 34

[56] References Cited

U.S. PATENT DOCUMENTS

| | | | |
|---|---|---|---|
| Re. 25,257 | 10/1962 | Ellis, Jr. . | |
| 3,141,381 | 7/1964 | MacDonald . | |
| 3,661,053 | 5/1972 | Rich | 200/82 R |
| 3,726,191 | 4/1973 | Johnston et al. . | |
| 4,207,565 | 6/1980 | Isakson et al. | 92/5 R |
| 4,210,064 | 7/1980 | Beerens | 92/85 B |
| 4,316,145 | 2/1982 | Tann . | |
| 4,523,514 | 6/1985 | Burk . | |
| 4,632,018 | 12/1986 | Lymburner . | |
| 4,656,457 | 4/1987 | Brausfeld et al. . | |
| 4,681,992 | 7/1987 | Kazmierski | 92/5 R |
| 4,726,282 | 2/1988 | La Bair | 92/5 R |

FOREIGN PATENT DOCUMENTS

| | | | |
|---|---|---|---|
| 2747676 | 4/1979 | Fed. Rep. of Germany | 92/169.1 |
| 3246731 | 6/1984 | Fed. Rep. of Germany | 324/207 |
| 2232234 | 12/1974 | France | 92/170.1 |
| 802662 | 2/1981 | U.S.S.R. | 92/177 |
| 2075148 | 11/1981 | United Kingdom | 92/85 B |

*Primary Examiner*—Edward K. Look
*Assistant Examiner*—Thomas Denion
*Attorney, Agent, or Firm*—Basile and Hanlon

[57] ABSTRACT

A fluid operated actuator includes a housing having a longitudinally extending aperture with open ends. First and second end caps are attached to opposite ends of the housing forming a chamber within the housing. A longitudinally reciprocal piston and attached rod are disposed within the chamber with the rod extending externally of the chamber through one of the end caps. The piston is adapted for reciprocal movement from one end limit of travel adjacent the first end cap to a second end limit of travel adjacent the second end cap. At least one of the first and second end caps includes a longitudinal aperture in communication with the chamber and a transverse aperture communicating between the longitudinal aperture and an exterior of the end cap. A sleeve is connected to the rod adjacent the piston and is engageable within the longitudinal aperture of the end cap when the piston is in the end limit of travel. A sensor is sealingly engaged within the transverse aperture of the end cap for sensing the piston in the end limit of travel. A retaining ring secures the sensor within the transverse aperture, while allowing pull-out removal of the sensor when the retaining ring is removed. The housing includes a recessed portion formed on an external surface defining two shoulders generally parallel to the end caps. Each shoulder has an aperture extending outwardly toward the end of the housing adjacent the end caps. Bolts are engaged through the aperture in the shoulders for threadingly securing the end cap to the housing, such that the end cap is removable without dismounting the fluid operated actuator.

13 Claims, 2 Drawing Sheets

FLUID OPERATED ACTUATOR WITH RECESSED POSITION SENSOR AND RECESSED END CAP FASTENER

FIELD OF THE INVENTION

The invention relates to fluid operated actuators and, more particularly, to actuators having recessed piston position sensors and recessed end cap fasteners.

BACKGROUND OF THE INVENTION

Fluid pressure operated actuators with piston position sensors are, generally speaking, known in the art, for example, see U.S. Pat. Nos. 4,656,457; 4,523,514; 3,726,191; 3,141,381; and Reissue No. 25,257. Fluid operated actuators find widespread use in machine and other manufacturing equipment. The actuators, typically of the compressed air or hydraulic operated type, use axial movement of a piston within a housing to effect a desired action of a working component attached to the external end of a piston rod connected to the piston. Control valves operated by sensors, such as limit switches, are employed to control the actuators by causing the desired directional movement of the piston at the correct time in the machine sequence.

Since it is often necessary to know when the piston has moved to the fully extended or retracted travel position before the next step in the machine sequence can take place, limit switches have been used to contact the external end of the piston rod or the connected work component at the end of piston travel. However, the use of such externally mounted limit switches encounter several problems since such switches are susceptible to damage in the crowded mechanical environment in which they are located. Furthermore, externally mounted limit switches are bulky and require special mounting arrangements which must be added to the machine.

To overcome these problems, sensors or limit switches have been mounted directly on fluid operated actuators and sense the position of the piston within the housing. For example, see U.S. Pat. No. 4,632,018 and U.S. Pat. No. 4,316,145. The sensors are contained within the housing mounted directly on the actuator, typically by fasteners, such as screws or bolts, and extend through a bore formed in the housing into proximity with the piston or piston rod.

While the use of sensors mounted directly on the housing eliminate many of the problems associated with externally positioned limit switches, they are not without their own disadvantages. Since such sensors are mounted in a single fixed position on the cylinder, the wiring or other connections to remotely located control equipment exit the housing from only one direction or side. This places considerable restraints on the machine designer in mounting a fluid operated cylinder on a machine since they must provide space for such connections in the oftentimes crowded machine environment.

Thus, it would be desirable to provide a fluid operated cylinder position sensor mounting apparatus which overcomes the problems associated with previously devised position sensor mounting apparatuses. It would also be desirable to provide a position sensor mounting apparatus for fluid operated cylinders which permits wiring or other connections leaving the sensor housing to be located in any desired orientation. Finally, it would be desirable to provide a position sensor mounting apparatus for fluid operated cylinders which can be located in any position or angular orientation on the cylinder without requiring removal and reattachment of the sensor on the cylinder.

SUMMARY OF THE INVENTION

A fluid operated, expansible chamber actuator includes a housing for receiving and supporting a position sensor. The housing is formed with a blind end cap, a rod end cap and a generally rectangular external cross-sectional tube having an elliptical through bore formed along the longitudinal axis of the tube, wherein the tube is interposed between the blind end cap and the rod end cap. A movable member, such as a piston and attached piston rod, are disposed within the tube for movement along a fixed path between a first end limit of movement and a second end limit of movement forming a first expansible fluid chamber between the reciprocal member and a first end of the housing, and forming a second, independent, expansible fluid chamber between the movable member and a second end of the housing. Expansion of the first fluid chamber drives the movable member to the first end limit of movement, and expansion of the second fluid chamber drives the movable member to the second end limit of movement. At least one end cap includes a longitudinal bore formed therein for receiving an enlarged sleeve carried by the piston rod adjacent the piston. A through bore is formed in the end cap for receiving and supporting the sensor, such that the sensor can be disposed in proximity with the enlarged sleeve carried by the piston rod within the housing when the piston is moved to the end limit of movement adjacent the end cap. The sensor is sealingly engaged within the through bore of the end cap for sensing the piston in the end limit of travel and is secured within the through bore by a retaining ring allowing pull-out removal of the sensor when the retaining ring is removed. To facilitate disassembly of the fluid operated actuator without dismounting the actuator, the housing includes recessed portions formed on the external surfaces adjacent the corner portions of the generally rectangular cross-sectional external surface. The recessed portions define two shoulders generally parallel to the end caps, wherein each shoulder has an aperture extending outwardly toward the end of the housing adjacent the end cap. Each end cap has a threaded aperture in coaxial relationship with the aperture through the shoulder. Bolts are engaged through the aperture for threading securement into the end cap, such that the end cap is removable without dismounting the actuator.

Other advantages and applications of the present invention will become apparent to those skilled in the art when the following description of the best mode contemplated for practicing the invention is read in conjunction with the accompanying drawings.

BRIEF DESCRIPTION OF THE DRAWINGS

The description makes reference to the accompanying drawings wherein like references numerals refer to like parts throughout the various views, and wherein.

DESCRIPTION OF THE PREFERRED EMBODIMENTS

Figure 1:
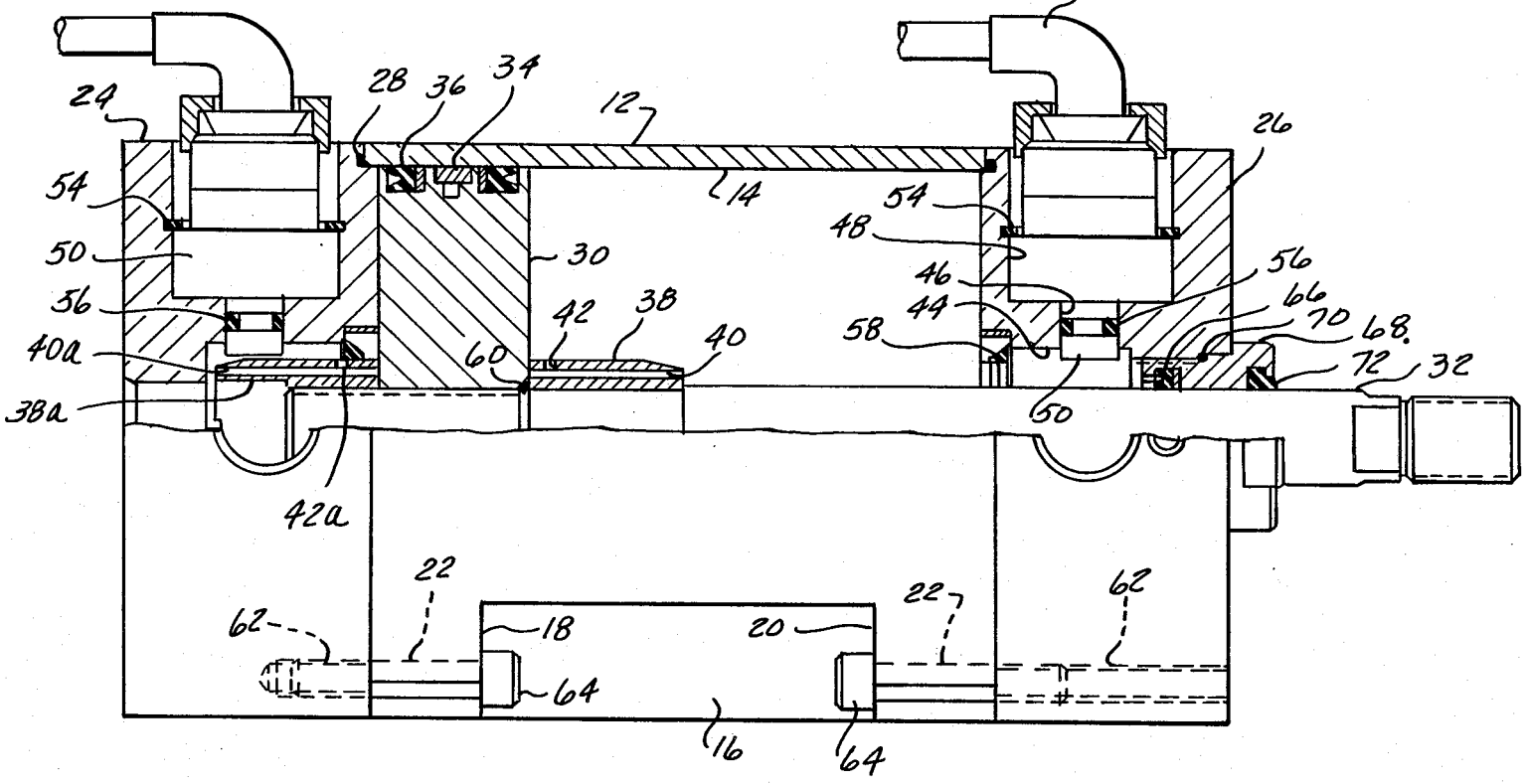
FIG. 1 is a partial cross-sectional view of a fluid operated actuator according to the present invention with a reciprocal piston in a first position.
Figure 2:
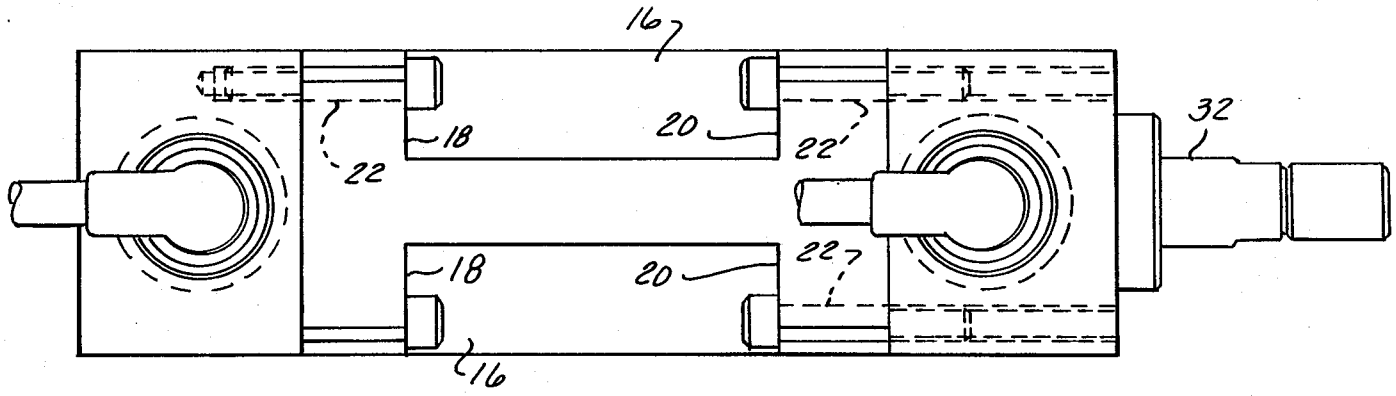
FIG. 2 is a top view of the fluid operated actuator shown in FIG. 1.
Figure 3:
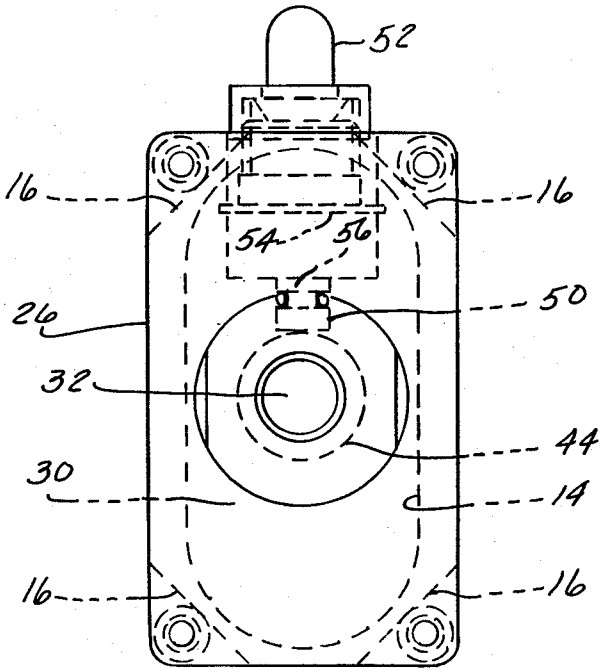
FIG. 3 is an end view of the fluid operated actuator shown in FIG. 1.

The fluid operated actuator, designated generally 10, includes a tube-like housing member 12 having a longitudinally extending aperture 14 with open ends. Preferably, the housing member 12 is formed of extruded aluminum having a generally rectangular cross-sectional exterior surface with an elliptical aperture formed therethrough. The exterior surface of the housing member 12 has recessed or cut-out portions 16 adjacent the longitudinal corners of the exterior rectangular cross section. The recessed portions 16 define two shoulders, 18 and 20 respectively, generally parallel to the ends of the housing member 12. Each shoulder has an aperture 22 extending outwardly toward the end of the housing member 12. First and second end caps, 24 and 26 respectively, are attached to opposite ends of the housing member 12 forming a chamber within the housing member. Seal means 28 are provided between the connection of the first and second end caps 24 and 26 to the housing member 12. A reciprocal member, such as piston 30 and an attached piston rod 32 are disposed within the chamber with the piston rod 32 extending externally of the chamber through one of the end caps, such as the second end cap 26. The piston 30 is adapted for reciprocal movement from a first end limit of travel adjacent one end cap to a second end limit of travel adjacent the other end cap. The piston 30 includes a wear ring 34 and at least one piston seal with seal back-up, designated generally 36. A sleeve 38 is carried by the piston rod 32 adjacent the piston 30. The sleeve 38 forms an enlarged shoulder on the piston rod 32 adjacent the piston 30. The sleeve 38 includes a longitudinal aperture 40 in fluid communication with a radial aperture 42. Of course, a second sleeve **38*a* can be attached to the piston rod 32 adjacent the other side of the piston 30, as shown in FIG. 1. The second sleeve 38*a* would include a longitudinal passage 40*a* and a radial passage 42*a*. At least one end cap has a longitudinal aperture 44 adapted to receive the sleeve 38 when the piston 30 is in the end limit of travel adjacent the respective end cap. A transverse aperture or a through bore 46 is in communication with the longitudinal aperture 44 and includes an enlarged bore portion 48 opening externally of the end cap which is adapted to receive a proximity switch 50. Any type of proximity switch or position sensor may be mounted in the enlarged bore portion 48. By way of example and not limitation, the proximity switch 50 may be a magnetically biased reed switch to detect the presence of the sleeve 38 within the longitudinal aperture 44, or a position sensor which detects a build-up of pressure at the end of piston travel, or a plunger-type switch to detect, by actual contact, the presence of the sleeve 38 at the end point of piston travel. In any case, the sensor or switch 50 is disposed entirely within the corresponding end cap, which protects the sensor or switch 50 from damage. A connector 52 attaches to the switch 50 to send the desired signal to remotely located control equipment. The means for mounting the proximity switch 50 within the end cap includes a retaining ring 54 which engages within an annular groove formed in the enlarged bore portion 48 and abuts against a shoulder of the proximity switch 50 to secure the proximity switch 50 in place. A seal ring 56 is provided in the through bore 46 to seal between the through bore 46 and the proximity switch 50. The retaining ring 54 allows the proximity switch 50 to be located in any position or angular orientation in the end cap without requiring removal or reattachment of the sensor within the end cap. In addition, the retaining ring 54 simplifies the removal and replacement of the proximity switch 50 by allowing the proximity switch 50 to be removed from the end cap with a straight pull-out movement after the retaining ring 54** is removed.

A cushion seal 58 is disposed in the longitudinal aperture 44 in the end cap adjacent the opening into the chamber in the housing member 12. As the enlarged shoulder or sleeve 38 enters the longitudinal aperture 44, fluid is metered between the longitudinal aperture 44 and the chamber in the housing member 12 through the longitudinally parallel aperture 40 and the radial aperture 42, while the cushion seal 58 engages the sleeve 38. This combination of elements provides cushioning means for slowing the piston adjacent the end limits of travel. As depicted in FIG. 1, the sleeve 38 slidingly engages over a narrowed shoulder portion of the piston rod 32 abutting against an enlarged diameter shoulder portion of the piston rod 32. A piston seal 60 is engaged within an annular groove formed in the piston rod 32 between the sleeve 38 and the piston 30. In this configuration, the piston 30 and cushioning spud or second sleeve **38*a* are threadingly engaged on the piston rod 32**.

Each end cap, 24 and 26, has a threaded aperture 62 in coaxial relationship with the aperture 22 extending from the respective shoulders 18 and 20 formed by the recess portion 16. Bolts 64 are engaged through the apertures 22 for threading securement into the threaded aperture 62 in the end caps, such that the end caps are removable without dismounting the fluid operated actuator from the associated machinery that it is used in conjunction with. This configuration greatly simplifies the disassembly and maintenance of the fluid operated actuator, since one end cap can be removed without disassembling the entire fluid operated actuator as is typically the case in prior known actuators, wherein a plurality of bolts pass through both end caps to compressively engage the cylinder between the two end caps.

The rod end cap, or second end cap 26, includes a rod seal with seal back-up, designated generally 66. A rod gland 68 is provided with a gland seal 70 and rod wiper 72.

While the invention has been described in detail, it will be apparent to those skilled in the art that the disclosed invention may be modified. Therefore, the foregoing description is to be considered exemplary, rather than limiting and the true scope of the invention is that defined in the following claims.

What is claimed is:

1. A fluid operated actuator comprising:

a housing member having a longitudinally extending aperture with open ends;

first and second end caps for attachment to opposite ends of the housing forming a chamber within the housing;

means for sealingly connecting the first and second end caps to the housing;

a longitudinally reciprocal piston member and attached rod disposed within the chamber with the rod extending externally of the chamber through one of the end caps, the piston member adapted for reciprocal movement from one end limit of travel to a second end limit of travel;

at least one of the first and second end caps having a longitudinal aperture in communication with the chamber and a transverse aperture communicating between the longitudinal aperture and an exterior of the end cap, the transverse aperture including an enlarged portion adjacent the exterior of the end cap;

enlarged shoulder means carried by the rod adjacent the piston member and engageable within the longitudinal aperture of the end cap when the piston member is in one of the end limits of travel;

sensor means sealingly engaged within the transverse aperture of the end cap for sensing the piston member in the end limit of travel, wherein a substantial portion of the sensor means is received within the enlarged portion of the transverse aperture such that an exterior end of the sensor means is generally flush with the exterior of the end cap providing a low profile between the end cap and the sensor means; and retaining ring means for securing the sensor means within the transverse aperture while allowing pull-out removal of the sensor means when the retaining ring means is removed.

2. The fluid operated actuator of claim 1 wherein the means for sealingly connecting the end caps to the housing further comprises:

said housing having a recessed portion formed on an external surface defining two shoulders generally parallel to the end caps, each shoulder having an aperture extending outwardly toward the end of the housing adjacent the end cap;

each end cap having a threaded aperture in coaxial relationship with the aperture through the shoulder; and bolt means engaging through the aperture for threadingly securing the end cap to the housing member, such that the end cap is removable without dismounting the fluid operated actuator.

3. The fluid operated actuator of claim 1 further comprising cushioning means for slowing the piston member adjacent one of the end limits of travel.

4. The fluid operated actuator of claim 1 wherein the piston member has an elliptical piston face and the housing member has an elliptical longitudinal aperture.

5. The fluid operated actuator of claim 4, wherein a longitudinal axis of the transverse aperture in the end cap is disposed parallel to a major axis of the elliptical piston face.

6. The fluid operated actuator of claim 1 further comprising:

the transverse aperture having a narrowed portion between the enlarged portion and the longitudinal aperture in the end cap and, means for sealing the sensor means disposed between the sensor means and the narrow portion spaced longitudinally along the transverse aperture from the retaining ring means.

7. The fluid operated actuator of claim 1, wherein the retaining ring means is disposed within the enlarged portion of the transverse aperture.

8. The fluid operated actuator of claim 1 wherein the retaining ring means allows rotation of the sensor means within the transverse aperture to orientate external connections in any desired angular position with respect to the transverse aperture.

9. A fluid operated actuator comprising:

a housing member having a longitudinally extending aperture with open ends;

first and second end caps for attachment to opposite ends of the housing forming a chamber within the housing;

means for sealingly connecting the first and second end caps to the housing;

a longitudinally reciprocal piston member and attached rod disposed within the chamber with the rod extending externally of the chamber through one of the end caps, the piston member adapted for reciprocal movement from one end limit of travel to a second end limit of travel;

at least one of the first and second end caps having a longitudinal aperture in communication with the chamber and a transverse aperture communicating between the longitudinal aperture and an exterior of the end cap;

enlarged shoulder means carried by the rod adjacent the piston member and engageable within the longitudinal aperture of the end cap when the piston member is in one of the end limits of travel;

sensor means sealingly engaged within the transverse aperture of the end cap for sensing the piston member in the end limit of travel;

retaining ring means for securing the sensor means within the transverse aperture while allowing pull-out removal of the sensor means when the retaining ring means is removed; and cushioning means for slowing the piston member adjacent one of the end limits of travel, wherein the cushioning means includes;

said enlarged shoulder means including a longitudinally parallel aperture and a radial aperture; and a cushion seal disposed in the longitudinal end cap aperture adjacent the chamber, such that as the enlarged shoulder means enters the longitudinal aperture, fluid is metered between the aperture and the chamber through the longitudinally parallel aperture and the radial aperture in the shoulder means, while the cushion sealingly engages the shoulder means.

10. A fluid operated actuator comprising:

an extruded aluminum housing having a generally rectangular exterior cross section and a longitudinally extending elliptical aperture with open ends, the housing further having recessed portions formed by angled cut-outs across corner sections of the rectangular exterior cross section defining shoulders generally parallel to ends of the housing, the shoulders having apertures extending outwardly toward the ends of the housing;

first and second end caps for attachment to opposite ends of the housing to form a chamber within the housing, each end cap having threaded apertures in coaxial relationship with the apertures through the shoulders;

a longitudinally reciprocal piston member having an elliptical cross section and an attached rod extending externally of the chamber through one of the end caps, the piston member adapted for reciprocal movement from one end limit of travel adjacent the first end cap to a second end limit of travel adjacent the second end cap; and bolt means engaging through the shoulder apertures for threadingly securing the end caps to the housing, such that the end caps are removable without dismounting the fluid operated actuator.

11. The fluid operated actuator of claim 10 further comprising:

each of the end caps having a longitudinal aperture in communication with the chamber and a transverse aperture communicating between the longitudinal aperture and an exterior of each end cap;

enlarged shoulder means connected to the piston rod adjacent the piston member and engageable within the longitudinal aperture of the end cap when the piston member is in one of the end limits of travel;

sensor means sealingly engaged within the transverse aperture of the end cap for sensing the piston member when in one of the end limits of travel; and retaining means for securing the sensor means within the transverse aperture, while allowing pull-out removal of the sensor means when the retaining means is removed.

12. The fluid operated actuator of claim 11 further comprising cushioning means for slowing the piston member adjacent the end limit of travel.

13. The fluid operated actuator of claim 12 wherein the cushioning means comprises:

said enlarged shoulder means including a longitudinally parallel aperture and a radial aperture; and a cushion seal disposed between the longitudinal aperture in the end cap and the chamber, such that as the enlarged shoulder means enters the longitudinal aperture, fluid is metered between the longitudinal aperture and the chamber through the longitudinally parallel aperture and the radial aperture, while the cushion seal sealingly engages the shoulder means.

* * * * *